US007108587B2

(12) United States Patent
Luedeke

(10) Patent No.: US 7,108,587 B2
(45) Date of Patent: Sep. 19, 2006

(54) BACKUP SHOE FOR MICROFINISHING AND METHODS

(75) Inventor: Arthur P. Luedeke, Marine on St. Croix, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/119,785

(22) Filed: May 2, 2005

(65) Prior Publication Data

US 2005/0245179 A1 Nov. 3, 2005

Related U.S. Application Data

(60) Provisional application No. 60/567,762, filed on May 3, 2004.

(51) Int. Cl.
*B24B 1/00* (2006.01)

(52) U.S. Cl. ..... 451/59; 451/303

(58) Field of Classification Search ..... 451/59, 451/49, 296, 302, 303, 168, 170
See application file for complete search history.

(56) References Cited

U.S. PATENT DOCUMENTS

| | | | | |
|---|---|---|---|---|
| 4,047,902 | A | | 9/1977 | Wiand |
| 4,256,467 | A | | 3/1981 | Gorsuch |
| 4,541,842 | A | | 9/1985 | Rostoker |
| 4,652,275 | A | | 3/1987 | Bloecher et al. |
| 4,682,444 | A | | 7/1987 | Judge et al. |
| 4,773,920 | A | | 9/1988 | Chasman et al. |
| 4,799,939 | A | | 1/1989 | Bloecher et al. |
| 4,863,573 | A | | 9/1989 | Moore et al. |
| 4,993,191 | A | | 2/1991 | Judge et al. |
| 5,014,468 | A | | 5/1991 | Ravipati et al. |
| 5,049,165 | A | * | 9/1991 | Tselesin ..... 51/295 |
| 5,109,638 | A | | 5/1992 | Kime, Jr. |
| 5,152,917 | A | | 10/1992 | Pieper et al. |
| 5,318,604 | A | | 6/1994 | Gorsuch et al. |
| 5,435,816 | A | | 7/1995 | Spurgeon et al. |
| 5,490,808 | A | * | 2/1996 | Jantschek et al. ..... 451/59 |
| 5,531,631 | A | * | 7/1996 | Judge ..... 451/5 |
| 5,549,962 | A | | 8/1996 | Holmes et al. |
| 5,725,421 | A | * | 3/1998 | Goers et al. ..... 451/303 |
| 5,975,988 | A | | 11/1999 | Christianson |

FOREIGN PATENT DOCUMENTS

DE 196 07 821 A1 9/1997

OTHER PUBLICATIONS

Article: Judge, "Crankshafts Finished and Sized," *American Machinist,* vol. 139, Jun. 1995, pp. 32-40.

* cited by examiner

*Primary Examiner*—Dung Van Nguyen
(74) *Attorney, Agent, or Firm*—Thomas M. Spielbauer

(57) ABSTRACT

A shoe for supporting an abrasive tape having an abrasive face and an opposed back face, wherein the shoe comprises a support surface including a frictional engagement material for frictionally engaging the back face of the abrasive tape. The frictional engagement material comprises a plurality of individual frictional engagement areas on a flexible substrate, each frictional engagement area having a plurality of abrasive particles. In an exemplary embodiment, the frictional engagement material comprises diamond abrasive particles retained in a nickel matrix supported on a flexible mesh substrate. The support surface of the shoe may be curvilinear, arcuate, convex, or concave.

18 Claims, 2 Drawing Sheets

BACKUP SHOE FOR MICROFINISHING AND METHODS

CROSS REFERENCE TO RELATED APPLICATION

This application claims the benefit of U.S. Provisional Patent Application No. 60/567,762, filed May 3, 2004.

FIELD OF THE INVENTION

The present invention relates to an apparatus for abrading a workpiece, such as a thrustwall.

BACKGROUND OF THE INVENTION

It is common to use abrasives to abrade specified amounts of material from the outer surface of a workpiece to provide a desired workpiece shape and surface finish. In the automotive field, for example, lobes or thrustwalls of camshafts and crankshafts for internal combustion engines must meet exacting standards for geometry and surface finish. If a camshaft or a crankshaft is improperly sized or finished, undesired wear patterns may result.

One manner of finishing the outer peripheral surface of a workpiece, such as a thrustwall, is to provide a shoe having a smooth pressure face against which an abrasive sheet or tape is placed. In some cases, the shoe is provided with conventional honing shoe inserts, where the pressure face of the shoe includes the smooth surface of the honing shoe inserts. The workpiece, the shoe, or both, are moved so that the abrasive face of the tape is brought in contact with the surface of the workpiece. The workpiece is then rotated with respect to the shoe to abrade the workpiece surface. The abrasive tape may be, for example, a coated abrasive, a lapping abrasive, or a nonwoven abrasive. Examples of camshaft and crankshaft microfinishing are described in U.S. Pat. No. 4,682,444 (Judge et al.) and U.S. Pat. No. 4,993,191 (Judge et al.).

After a certain amount of use, the portion of the abrasive sheet or tape contacting the workpiece will begin to degrade or wear out, which can cause irregular finishing of the workpiece. To continue abrading workpieces, it is therefore common to advance the abrasive tape periodically to provide a new abrasive surface to the workpiece. Advancing the abrasive tape in this manner is referred to as "indexing" the abrasive tape. To allow for ease in indexing the abrasive, the abrasive tape or sheet typically is not permanently fixed or adhered to the pressure face.

Although the abrasive tape is typically releasable from the pressure face to allow indexing, it is important to maintain the abrasive tape in position with respect to the pressure face during the abrading process. If the abrasive tape slips, it may not be properly positioned over the pressure face, which may cause the abrasive tape to tear or break. In automated abrading processes, a dislocation of or break in the tape may damage multiple workpieces before the dislocation or break is detected. In addition, if an abrasive tape breaks the manufacturing operation must shut down. Moreover, if the abrasive tape slips such that it becomes significantly displaced with respect to the pressure face, portions of the pressure face may be exposed to the workpiece during abrasion. In this situation, the workpiece may contact the pressure face rather than the abrasive tape during the abrading process, which may cause improper finishing of the workpiece, and may damage both the workpiece and the pressure face.

While there are various ways of reducing slippage of abrasive tape with respect to the pressure face in finishing operations, additional improvements in the releasable engagement between the abrasive tape and shoe are always desired.

SUMMARY OF THE INVENTION

The present invention is directed to shoes for supporting an abrasive article during abrading applications. The invention is also directed to methods of using particular shoes for abrading applications, such as microfinishing applications. Still further the invention is directed to an apparatus for abrading a, lobe or thrustwall of a cam shaft or crank shaft.

The invention, generally, is directed to a shoe for supporting an abrasive tape having an abrasive face and an opposed back face, wherein the shoe comprises a support surface including a frictional engagement material for frictionally engaging the back face of the abrasive tape. The frictional engagement material comprises a plurality of individual frictional engagement areas on a flexible substrate, each frictional engagement area having a plurality of abrasive particles. In an exemplary embodiment, the frictional engagement material comprises diamond abrasive particles retained in a nickel matrix supported on a flexible mesh substrate. The support surface of the shoe may be flat, curvilinear, arcuate, convex, or concave.

In one example embodiment, the invention is to a shoe for supporting an abrasive tape, the tape having an abrasive face and an opposed back face. The shoe has a support surface including a frictional engagement material for frictionally engaging the back face of the abrasive tape. This frictional engagement material comprises a flexible substrate and a plurality of individual, discrete frictional engagement areas present on the substrate, each engagement area comprising a plurality of abrasive particles and binder, wherein at least some of the abrasive particles protrude beyond an outer surface of the binder. When the back face of the abrasive tape contacts the frictional engagement surface of the shoe, the plurality of particles attenuate relative movement between the abrasive tape and the shoe in response to shear forces induced during abrading.

In one exemplary version of this embodiment, the abrasive particles are diamond or cubic boron nitride, and the binder is nickel.

In another example embodiment of this invention, a method for abrading a thrustwall is disclosed, the method comprising providing an abrasive tape having an abrasive face and an opposed back face, providing a shoe for supporting the abrasive tape thereon and for urging the abrasive tape against the thrustwall, and rotating the thrustwall and the shoe relative to one other, whereby the abrasive face abrades material from a surface of the thrustwall during relative rotation between the thrustwall and the shoe. The shoe has a support surface including a frictional engagement material for frictionally engaging the back face of the abrasive tape, and this frictional engagement material comprises a flexible substrate and a plurality of individual, discrete frictional engagement areas present on the substrate, each engagement area comprising a plurality of abrasive particles and binder, wherein at least some of the abrasive particles protrude beyond an outer surface of the binder. During the abrading a first coefficient of friction is induced between the back face of the abrasive tape and the frictional engagement surface, and a second coefficient of friction is induced between the abrasive face and the outer peripheral surface of the thrustwall during relative rotation between the thrustwall and the shoe, and wherein the first coefficient of friction is larger than the second coefficient of friction.

In yet another particular embodiment of this invention, an apparatus for abrading a thrustwall is disclosed. This apparatus comprises an abrasive tape having an abrasive face and an opposed back face, a shoe for supporting the abrasive tape thereon and for urging the abrasive tape against the thrustwall, and means for rotating the thrustwall and the shoe relative to the other, whereby the abrasive face abrades material from the outer peripheral surface of the thrustwall during relative rotation between the thrustwall and the shoe. The shoe includes a frictional engagement material for frictionally engaging the back face of the abrasive tape. This frictional engagement material comprises a flexible substrate a plurality of individual, discrete frictional engagement areas present on the substrate, each engagement area comprising a plurality of abrasive particles and binder, wherein at least some of the abrasive particles protrude beyond an outer surface of the binder.

DETAILED DESCRIPTION

The present invention relates, in general, to an apparatus for abrading a workpiece, such as a thrustwall. More specifically, the apparatus includes a shoe for supporting an abrasive tape, the shoe having a frictional engagement material on a pressure face for frictionally engaging the abrasive tape. The frictional engagement between the frictional engagement material of the shoe and the abrasive tape attenuates relative displacement of the abrasive tape as the workpiece is abraded. Although the workpiece is typically rotated with respect to a stationary-shoe, the workpiece could be held stationary and the shoe rotated, or the two components could be rotated in opposite directions simultaneously. Thus the present invention should be understood to have general utility in rotative abrading generally, but can also be used in abrading where there is planar motion.

Figure 1:
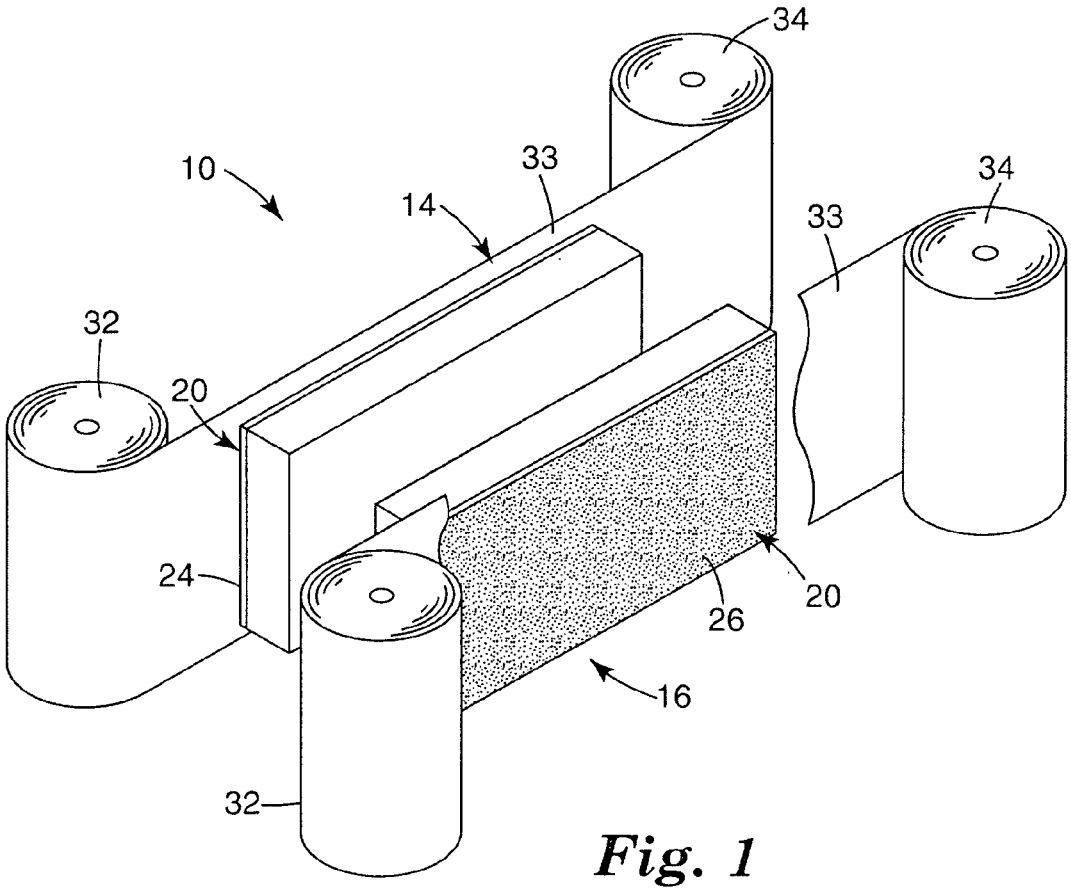
FIG. 1 is a perspective view of a first embodiment of a pair of shoes according to the present disclosure.
Figure 2:
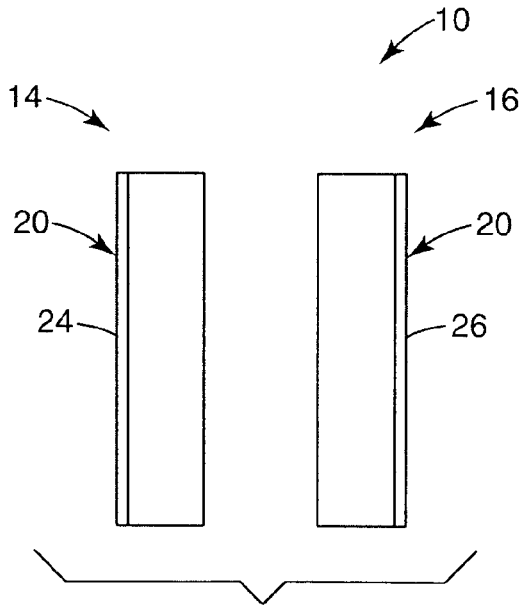
FIG. 2 is an end view of the shoes of FIG. 1.

Referring to FIGS. 1 and 2, a first embodiment of shoes 10 is illustrated as first shoe 14 and second shoe 16. Shoes 10 are used in processes for abrading material from surfaces of a workpiece, such as camshafts and crankshafts. Such surfaces include, for example, thrustwalls, lobes and journals.

Each shoe 14, 16 has a support surface 20, specifically, support surfaces 24, 26, respectively. Support surfaces 20 match the desired profile of the workpiece being abraded. In the illustrated embodiment of FIGS. 1 and 2, support surfaces 24, 26 are each planar, configured to match the workpiece to be abraded. Such shoes 14, 16 are often referred to as "thrustwall shoes".

Figure 3:
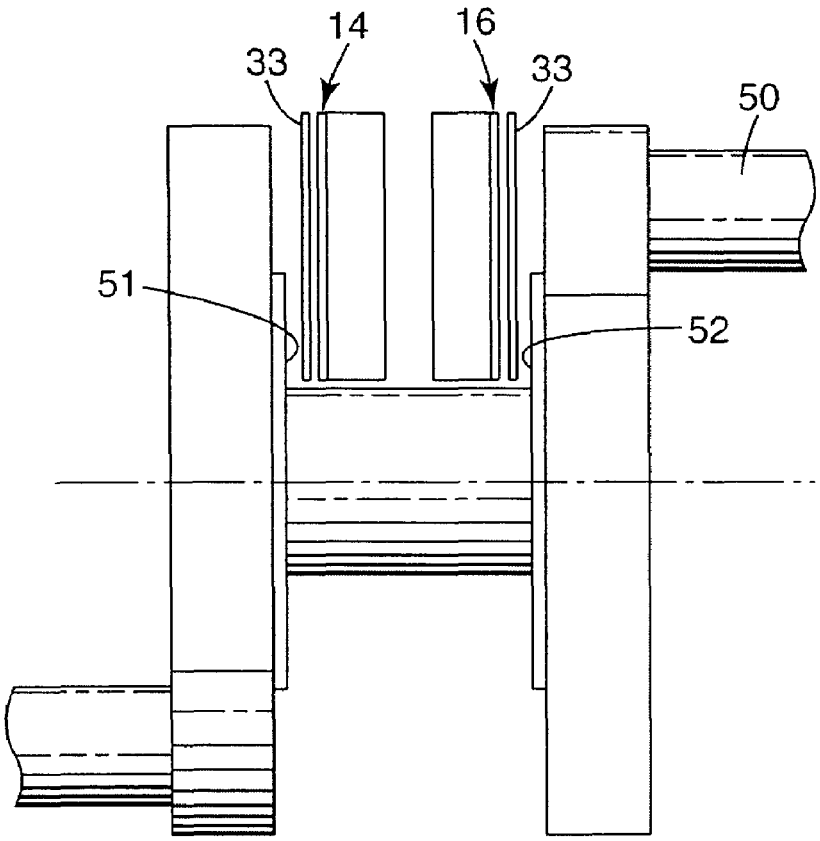
FIG. 3 is a side view of an embodiment of a pair of shoes according to the present disclosure positioned in relation to a thrustwall to be abraded, each shoe supporting an abrasive tape.

FIG. 3 illustrates shoes 10 in use on a workpiece. Specifically, shoes 14, 16 are illustrated positioned in relation to a workpiece 50. In the particular embodiment illustrated, workpiece 50 is a crankshaft. Shoes 14, 16 are positioned so that support surfaces 24, 26 support an abrasive tape 33 (supplied via a wind 34/unwind 32 system, the details of which are not a part of the present invention and, therefore, not shown). against internal surfaces 51, 52 of workpiece 50.

Figure 4:
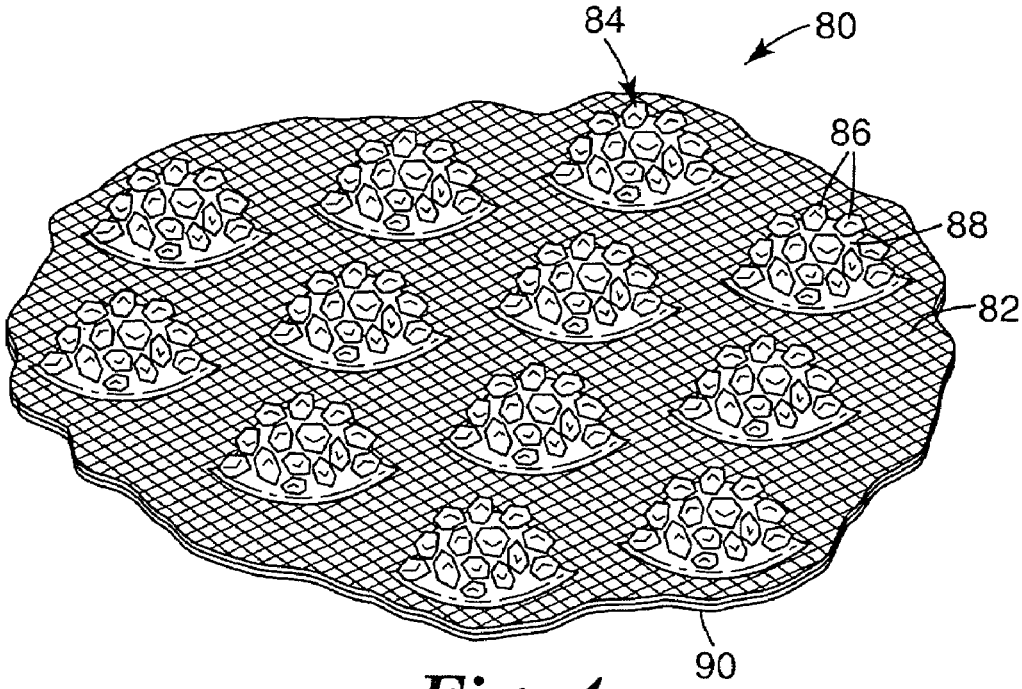
FIG. 4 is a perspective view of an exemplary frictional engagement material for a support surface of the shoes of FIGS. 1–3.

As described above, shoes 10 include support surfaces 20, which support an abrasive tape and generally conform to the surface of the workpiece to be abraded. For example, in FIG. 3, generally flat portions 51, 52 of workpiece 50 are adapted for rotation with respect to shoes 14, 16, which include flat support surfaces 24, 26. FIG. 4 illustrates a frictional engagement material, indicated at reference numeral 80. Material 80 has a flexible substrate 82 supporting discrete, individual friction areas 84. These areas 84 comprise abrasive particles 86 held to substrate 82 by a binder 88.

Substrate 82 can be any material that is flexible. Typically, a flexible substrate 82 is capable of being conformed to an arcuate object without imparting undue stress into the substrate. Examples of typical flexible substrate 82 include paper, polymeric film, vulcanized fiber, and fibrous materials, such as woven or nonwoven materials, scrims, and meshes, treated versions thereof and combinations thereof. Suitable materials may comprises polyester, polypropylene, cotton, nylon, rayon, polyamides, polyaramides, and the like. Additionally, it is preferred that substrate 82 be porous or otherwise 'open', for example, like a woven scrim. The thickness of the flexible substrate 82 will generally be about 5 to 1000 micrometers, preferably about 25 to 250 micrometers. Optionally, an additional flexible support 90 is provided under substrate 82.

The thickness of the frictional material (i.e.: Flex Diamond material or other abrasives) adhered to the shoes plays a very important part in polishing or dimensioning the abraded area. For example, a thicker backed product (i.e.: cloth or polyester) provides compressibility in the backing allowing for improvements in surface finish. In essence, the softer the backing supporting the microfinishing film, the finer the finish. The thinner the backing on the frictional material becomes (i.e.: polyester film), the less compressible it is and the greater ability it has to generate geometric improvements. Unlike a plated diamond shoe, which is used primarily to make geometric improvements, this shoe design utilizes different thicknesses of frictional material enabling it to generate geometry, or follow existing geometry. The key in determining which backing to use is dependent upon the criteria of the application in which the shoes are being used.

On the front side of the substrate 82, a plurality of discrete, individual friction areas 84 are bonded. The discrete, individual friction areas 84 are individual entities and are spaced apart from one another. There is not a continuous friction area 84. The individual friction areas 84 provide a flexible material 80, which can be conformed to the support surface 20.

The height of the discrete, individual friction areas 84 will typically be about 25 to 800 micrometers, preferably about 20 to 450 micrometers from the surface of substrate 82. The diameter of the discrete, individual friction areas 84 will typically be about 0.1 to 5 mm, preferably about 0.2 to 3 mm, and, most preferably, about 0.25 to 2 mm. Approximately about 15 to 90%, preferably about 15 to 50%, of the substrate 82 surface area will contain discrete, individual friction areas 84. The discrete, individual friction areas 84 can have a random shape or form. Conversely, the discrete, individual friction areas 84 can have a geometric shape such as a circle, a triangle, square, rectangle, diamond, etc. In addition, the discrete, individual friction areas 84 can be arranged in a specified pattern on the backing Suitable examples of abrasive particles 86 for the friction engagement material include diamond, cubic boron nitride, fused alumina, heat treated alumina, ceramic aluminum oxide, alumina-zirconia, silicon carbide, garnet, tungsten carbide, boron carbide, titanium carbide, ceria, iron oxide, silica, and silicon nitride. The particle size of the abrasive particles 86 will be about 0.1 to 1000 micrometers, preferably about 1 to 100 micrometers. The shape of each abrasive particles 86 can be random or it can be a specified shape. The choice of grain size can vary, as the particular conditions of use require. Individual friction areas 84 may have a combination of two or more different abrasive particles 86. The individual friction areas 84 may also include diluent particles such as graystone, marble or gypsum. Additionally, in certain applications there may be a coating on the particles 86 to improve the adhesion to the binder 88.

The purpose of the binder 88 is to secure the abrasive particles 86 to the substrate 82. It is preferred that a portion of the abrasive particles 86 protrudes from and past the surface of the binder 88. The binder 88 can be an organic binder or an inorganic binder. Examples of organic binders include phenolic resins, urea-formaldehyde resins, acrylate resins, epoxy resins, melamine resins, aminoplast resins, isocyanate resins, urethane resins, polyester resins and combinations thereof. Examples of inorganic binders include metals, silicates, and silica. The preferred binder 88 is a metallic binder, and examples include tin, bronze, nickel, silver, iron, alloys thereof and combinations thereof.

It is most preferred that the binder 88 be applied to the substrate 82 by an electroplating process. The abrasive particles 86 are applied simultaneously during the electroplating process.

In a preferred embodiment of material 80, flexible substrate 82 is a porous, woven mesh, such as woven polyester material, flexible support 90 is paper or film, abrasive particles 86 are diamond or cubic boron nitride, and binder 88 is nickel. Preferably, at least a portion of binder 88 penetrates through substrate 82 to form an increased bond between individual friction areas 84 and substrate 82. Such material 80 is commercially available from 3M Company under the trade designation "Flex Diamond" abrasive articles, and is available with various sizes of diamond abrasive particles 86 (for example, 20 micrometer, 40 micrometer, 74 micrometer, 100 micrometer, and 120 micrometer).

In this exemplary embodiment of material 80, the nickel binder 88 is electroplated onto substrate 82. During the electroplating process, the flexible substrate 82 is placed over an electrically conductive metal drum and the nickel binder 88 is electroplated through the scrim. It is inherent in this process that a portion of the nickel will be on the back side of the substrate 82, and the remainder of the nickel will be present on the front side of the substrate 82 as the binder 88.

One exemplary process for preparing material 80 is described in U.S. Pat. No. 4,256,467 (Gorsuch), which is incorporated herein by reference. Another exemplary process for preparing material 80 is described in U.S. Pat. No. 5,318,604 (Gorsuch et al.), which is also incorporated herein by reference. Additional methods for making an exemplary frictional engagement material, such as material 80 of FIG. 4, are taught in U.S. Pat. No. 4,047,902 (Wiand) and U.S. Pat. No. 4,863,573 (Moore et al.), each of these being incorporated herein by reference.

As described above, shoe 10 has a support surface 20 to which a frictional engagement material is attached. The frictional engagement material is preferably attached to the support surface 20 by known attachment methods, such as adhering with an epoxy, and the like. A primer can be used to improve the bond.

The term "tape," as used throughout this description when referring to the abrasive, is not intended to limit the relative size or construction of the abrasive member used in conjunction with the shoes of the present invention. Typically, the abrasive tape is a narrow strip of abrasive material, where the length of the material is significantly larger than its width. The tape is typically provided by a supply roll of abrasive tape to the abrading apparatus.

In one exemplary embodiment, the abrasive tape is a coated abrasive as is known in the art, which comprises a plurality of abrasive particles attached to the substrate. The substrate may be, for example, a polymeric film, (including primed polymeric film), cloth, paper, a nonwoven material, rubber, or combinations thereof.

The abrasive tape includes a binder applied over the front face of the substrate. The plurality of abrasive particles are typically embedded into this binder. Examples of typical abrasive article binders include phenolic resins, aminoplast resins having pendant alpha, beta unsaturated carbonyl groups, urethane resins, hide glue, epoxy resins, acrylate resins, acrylated isocyanurate resins, urea-formaldehyde resins, isocyanurate resins, acrylated urethane resins, acrylated epoxy resins, and mixtures thereof. The binder can include additives, such as fillers, fibers, antistatic agents, humectants, lubricants, fire retardants, wetting agents, surfactants, pigments, dyes, coupling agents, plasticizers, suspending agents, and the like.

A second binder, commonly referred to as a size coat, may be applied over the abrasive particles. When using a size coat, the first binder is commonly referred to as a make coat. Typical examples of size coat materials include the same materials described above for the first binder. In some embodiments, a third binder (also not shown), commonly referred to as a supersize coating, may be applied over the second binder. A supersize coating is typically used to minimize loading of the abrasive substrate. The specific materials and components forming the abrasive tape may be selected to provide a desired abrading performance.

The abrasive particles are at least 0.01 micrometer and usually no greater than 400 micrometers in size, and are preferably about 1 to 120 micrometers, although finer or coarser particles may used as desired for the particular application. The abrasive particles may include, for example, aluminum oxide (including fused, ceramic, heat treated, or white aluminum oxide), silicon carbide, alumina zirconia, diamond, iron oxide, silica, ceria, cubic boron nitride, garnet, and combinations thereof.

The abrasive particles could be an abrasive agglomerate formed from single abrasive particles bonded together. Agglomerates include a plurality of abrasive particles held together by a binder, such as a resinous, glass, ceramic, or metal binder. The agglomerates are preferably about 1 micrometer to 1500 micrometers in size, and preferably are about 60 to 500 micrometers in size. The agglomerates may be precisely shaped or irregular. Examples of shaped agglomerates include cubes, four-sided pyramids, and truncated pyramids. Examples of abrasive agglomerates are described in U.S. Pat. No. 4,652,275 (Bloecher et al.); U.S. Pat. No. 4,799,939 (Bloecher et al); U.S. Pat. No. 4,541,842; U.S. Pat. No. 5,549,962 (Holmes et al.); and U.S. Pat. No. 5,975,988 (Christenson).

One alternative construction of the abrasive tape is referred to as a lapping coated abrasive, which comprises a plurality of abrasive particles distributed throughout a binder, where the binder also serves to bond the abrasive composite to the backing. One example of a lapping film is described in U.S. Pat. No. 4,773,920 (Chasman et al.).

Another alternative abrasive construction is a structured abrasive having three dimensional, precisely shaped abrasive composites bonded to a backing, such as that described in U.S. Pat. No. 5,152,917 (Pieper et al.), and in U.S. Pat. No. 5,435,816 (Spurgeon et al.). These precisely shaped abrasive composites may have various geometric shapes such as pyramids, truncated pyramids, cones, spheres, rods, tapered rods, and the like. Non-precisely shaped abrasive composites, such as described in U.S. Pat. No. 5,014,468 (Ravipati et al.), are also suitable.

The abrasive tape preferably includes a slip resistant backing layer on the back face of the substrate, the slip resistant coating generally comprising an inorganic particulate dispersed in a polymeric binder. One example of a backing layer is a coating of calcium carbonate particles in an adhesive material, as is used on the 372 and 382 Microfinishing film products Type S. Another example of a backing layer is a coating of quartz particles in an adhesive material, as is used on the 373 and 383 Microfinishing film products Type Q. It is understood that other particles may also be used in the backing layer, articles such as clay, metal shavings (e.g., bronze), aluminum oxide, silicon carbide, alumina zirconia, diamond, iron oxide, mullite, silica, ceria, cubic boron nitride, garnet and combinations thereof.

While an abrasive tape having a coating as the backing layer is preferred, other tape configurations may be used with the present invention. For example, the abrasive tape may have no backsize coating or may include any other type of coating on the back face 30, such as the gripper coating described in U.S. Pat. No. 5,109,638 (Kime, Jr.). For another example, the substrate may be a resilient foam, such as a urethane or acrylate, or may be a polymeric film coextruded with a polyester on one side and a polyolefin on the opposite side.

The backing layer is selected so that the friction between the frictional engagement material 80 on shoe 10 is greater than the friction present between the abrasive surface of the abrasive tape and the workpiece being abraded or finished. In other works, in used, a first coefficient of friction is induced between the back face of the abrasive tape and the frictional engagement material on the shoe, and a second coefficient of friction is induced between the abrasive face and the outer peripheral surface of the workpiece, during relative rotation between the workpiece and the shoe; the first coefficient of friction is larger than the second coefficient of friction.

Various modifications and alterations of this invention will become apparent to those skilled in the art without departing from the scope and principles of this invention, and it should be understood that this invention is not to be unduly limited to the illustrative embodiments set forth hereinabove.

The above specification provides a complete description of the construction and use of the shoes of the invention. Since many embodiments of the invention can be made without departing from the spirit and scope of the invention, the invention resides in the claims hereinafter appended.

What is claimed is:

1. A shoe for supporting an abrasive tape having an abrasive face and an opposed back face, the shoe comprising:

a support surface including a flexible frictional engagement material adhered to the support surface for frictionally engaging the back face of the abrasive tape, wherein the frictional engagement material comprises:

(i) a flexible substrate; and (ii) a plurality of individual, discrete frictional engagement areas present on the substrate, each engagement area comprising a plurality of abrasive particles and binder, wherein at least some of the abrasive particles protrude beyond an outer surface of the binder.

2. The shoe of claim 1, wherein the abrasive particles are diamond or cubic boron nitride.

3. The shoe of claim 2, wherein the abrasive particles are 6 to 250 micrometers.

4. The shoe of claim 1, wherein the binder is nickel.

5. The shoe of claim 1, wherein the discrete friction engagement areas present on the substrate are present as dots on the substrate.

6. The shoe of claim 1, wherein the substrate is a mesh material and the binder of the engagement areas is present on front and back sides of the mesh material.

7. The shoe of claim 1, wherein the frictional engagement material is adhered to the shoe with an epoxy.

8. The shoe of claim 1, wherein the support surface is flat.

9. The shoe of claim 1, wherein about 15 to 90% of a surface area of the substrate comprises the individual, discrete frictional engagement areas.

10. The shoe of claim 9, wherein about 15 to 90% of the surface area of the substrate comprises the individual, discrete frictional engagement areas.

11. The shoe of claim 1, wherein the flexible substrate comprises a material selected from the group consisting of paper, polymeric film, vulcanized rubber, polyester, polypropylene, cotton, nylon, rayon, polyamides, and polyaramides.

12. A shoe for supporting an abrasive tape having an abrasive face and an opposed back face, the shoe comprising:

a support surface including a flexible frictional engagement material adhered to the support surface for frictionally engaging the back face of the abrasive tape, wherein the frictional engagement material comprises:

(i) a flexible mesh substrate; and (ii) a plurality of individual, discrete frictional engagement areas present on the substrate, each engagement area comprising diamond abrasive particles and nickel binder.

13. A method for abrading a thrustwall, the method comprising:

(a) providing an abrasive tape having an abrasive face and an opposed back face;

(b) providing a shoe for supporting the abrasive tape thereon and for urging the abrasive tape against the thrustwall, the shoe having a support surface including a flexible frictional engagement material adhered thereto, for frictionally engaging the back face of abrasive tape, wherein the frictional engagement material comprises:

(i) a flexible substrate; and (ii) a plurality of individual, discrete frictional engagement areas present on the substrate, each engagement area comprising a plurality of abrasive particles and binder, wherein at least some of the abrasive particles protrude beyond an outer surface of the binder;

(c) rotating the thrustwall and the shoe relative to the other, whereby the abrasive face abrades material from a surface of the thrustwall during relative rotation between the thrustwall and the shoe, wherein a first coefficient of friction is induced between the back face of the abrasive tape and the flexible frictional engagement material and a second coefficient of friction is induced between the abrasive face and the surface of the thrustwall during relative rotation between the thrustwall and the shoe, and wherein the first coefficient of friction is larger than the second coefficient of friction.

14. The method of claim 13, wherein said providing a shoe comprises:

providing the shoe having the support surface including the flexible frictional engagement material comprising:

(i) the flexible substrate; and (ii) the plurality of individual, discrete frictional engagement areas present on the substrate, wherein each engagement area comprising a plurality of diamond or cubic boron nitride particles and nickel binder.

15. The method of claim 13, wherein the step of providing a shoe comprises:

providing the shoe having the support surface including the flexible frictional engagement material, wherein the flexible frictional engagement material is adhered to the support surface with epoxy.

16. The method of claim 13, wherein the flexible substrate comprises a material selected from the group consisting of paper, polymeric film, vulcanized rubber, polyester, polypropylene, cotton, nylon, rayon, polyamides, and polyaramides.

17. An apparatus for abrading an outer peripheral surface of a thrustwall, comprising:

(a) an abrasive tape having an abrasive face and an opposed back face;

(b) a shoe for supporting the abrasive tape thereon and for urging the abrasive tape against the thrustwall, the shoe including a flexible frictional engagement material for frictionally engaging the back face of the abrasive tape, wherein the frictional engagement material comprises:

(i) a flexible substrate; and (ii) a plurality of individual, discrete frictional engagement areas present on the substrate, each engagement area comprising a plurality of abrasive particles and binder, wherein at least some of the abrasive particles protrude beyond an outer surface of the binder;

(c) means for rotating the thrustwall and the shoe relative to the other, whereby the abrasive face abrades material from the outer peripheral surface of the thrustwall during relative rotation between the thrustwall and the shoe.

18. A method for abrading a workpiece face, the method comprising:

(a) providing an abrasive tape having an abrasive face and an opposed back face;

(b) providing a shoe for supporting the abrasive tape thereon and for urging the abrasive tape against the workpiece, the shoe having a support surface including a flexible frictional engagement material adhered thereto, for frictionally engaging the back face of abrasive tape, wherein the frictional engagement material comprises:

(i) a flexible substrate; and (ii) a plurality of individual, discrete frictional engagement areas present on the substrate, each engagement area comprising a plurality of abrasive particles, and binder, wherein at least some of the abrasive particles protrude beyond an outer surface of the binder;

(c) moving the workpiece and the shoe relative to the other, whereby the abrasive face abrades material from a surface of the workpiece during relative motion between the workpiece and the shoe, wherein a first coefficient of friction is induced between the back face of the abrasive tape and the flexible frictional engagement material and a second coefficient of friction is induced between the abrasive face and the surface of the workpiece during relative motion between the workpiece and the shoe, and wherein the first coefficient of friction is larger than the second coefficient of friction.

* * * * *

UNITED STATES PATENT AND TRADEMARK OFFICE

CERTIFICATE OF CORRECTION

PATENT NO. : 7,108,587 B2
APPLICATION NO. : 11/119785
DATED : September 19, 2006
INVENTOR(S) : Arthur P. Luedeke It is certified that error appears in the above-identified patent and that said Letters Patent is hereby corrected as shown below:

Column 8
Line 27, In Claim 10, delete "90%" and insert -- 50% -- therefor.

Signed and Sealed this

Twenty-sixth Day of December, 2006

JON W. DUDAS
*Director of the United States Patent and Trademark Office*